US006691789B2

(12) United States Patent
Jackson et al.

(10) Patent No.: US 6,691,789 B2
(45) Date of Patent: Feb. 17, 2004

(54) EXPANDABLE HANGER AND PACKER

(75) Inventors: Stephen L. Jackson, Richmond, TX (US); Patrick Maguire, Cypress, TX (US); Khai Tran, Pearland, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/132,424

(22) Filed: Apr. 25, 2002

(65) Prior Publication Data

US 2003/0047323 A1 Mar. 13, 2003

Related U.S. Application Data

(63) Continuation-in-part of application No. 09/949,986, filed on Sep. 10, 2001.

(51) Int. Cl.[7] ..... E21B 17/00; E21B 43/00

(52) U.S. Cl. ..... 166/384; 166/207; 166/242.2; 285/259; 285/373

(58) Field of Search ..... 166/277, 384, 166/383, 206, 207, 208, 212, 242.2, 242.6; 285/236, 371, 259, 369, 373

(56) References Cited

U.S. PATENT DOCUMENTS

| | | | | |
|---|---|---|---|---|
| 761,518 | A | 5/1904 | Lykken | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,930,825 | A | 10/1933 | Raymond | 153/81 |
| 1,981,525 | A | 11/1934 | Price | 166/4 |
| 2,214,226 | A | 9/1940 | English | 166/1 |
| 2,383,214 | A | 8/1945 | Prout | 153/82 |
| 2,499,630 | A | 3/1950 | Clark | 153/81 |

(List continued on next page.)

FOREIGN PATENT DOCUMENTS

| | | | |
|---|---|---|---|
| EP | 0 961 007 A2 | 12/1999 | E21B/33/10 |
| GB | 2 216 926 | 10/1989 | E21B/7/20 |
| GB | 2 320 734 A | 7/1998 | E21B/33/127 |
| GB | 2 329 918 A | 4/1999 | E21B/43/10 |
| GB | 2 345 308 A | 7/2000 | E21B/43/10 |
| WO | WO 93/24728 | 12/1993 | E21B/17/10 |
| WO | WO 99/18328 | 4/1999 | E21B/23/01 |
| WO | WO 99/23354 | 5/1999 | E21B/43/10 |
| WO | WO 00/37766 | 6/2000 | E21B/29/00 |
| WO | WO 00/37767 | 6/2000 | E21B/29/00 |
| WO | WO 00/37768 | 6/2000 | E21B/29/10 |
| WO | WO 00/37772 | 6/2000 | E21B/43/10 |

OTHER PUBLICATIONS

U.S. patent application Ser. No. 09/949,057, Coon, filed Sep. 7, 2001.

(List continued on next page.)

*Primary Examiner*—David Bagnell
*Assistant Examiner*—Jennifer H Gay
(74) *Attorney, Agent, or Firm*—Moser, Patterson & Sheridan, L.L.P.

(57) ABSTRACT

An apparatus and method of creating a seal between two coaxial tubulars so as to create a hanger and a packer. A first tubular is disposed coaxially within a portion of a second, larger tubular. A portion of the first tubular is expanded into frictional contact with the second tubular, thereby creating a liner and a hanger. In one embodiment, a pattern of grooves and profile cuts are formed in the surface of a portion of the first tubular body. The grooves in one aspect define a continuous pattern about the circumference of the tubular body which intersect to form a plurality of substantially identical shapes, such as diamonds. The grooves and profile cuts serve to improve the tensile strength of the tubular body. At the same time, the grooves and profile cuts allow for expansion of the tubular body by use of less radial force. The grooves and profile cuts further provide a gripping means, providing additional frictional support for hanging the expanded tubular onto the inner surface of a surrounding second tubular.

31 Claims, 6 Drawing Sheets

U.S. PATENT DOCUMENTS

| | | | | | |
|---|---|---|---|---|---|
| 2,627,891 | A | | 2/1953 | Clark | 153/82 |
| 2,663,073 | A | | 12/1953 | Bieber et al. | 29/148 |
| 2,898,971 | A | | 9/1959 | Hempel | 153/82 |
| 3,087,546 | A | | 4/1963 | Wooley | 166/46 |
| 3,191,677 | A | | 6/1965 | Kinley | 166/14 |
| 3,195,646 | A | | 7/1965 | Brown | 166/208 |
| 3,208,531 | A | | 9/1965 | Tamplen | 166/125 |
| 3,467,180 | A | | 9/1969 | Pensotti | 165/180 |
| 3,712,376 | A | | 1/1973 | Owen et al. | 166/277 |
| 3,776,307 | A | | 12/1973 | Young | 166/125 |
| 3,818,734 | A | | 6/1974 | Bateman | 72/75 |
| 3,893,717 | A | | 7/1975 | Nelson | 285/3 |
| 3,911,707 | A | | 10/1975 | Minakov et al. | 72/76 |
| 3,948,321 | A | | 4/1976 | Owen et al. | 166/277 |
| 4,069,573 | A | | 1/1978 | Rogers, Jr. et al. | 29/421 R |
| 4,127,168 | A | | 11/1978 | Hanson et al. | 166/123 |
| 4,159,564 | A | | 7/1979 | Cooper, Jr. | 29/727 |
| 4,288,082 | A | | 9/1981 | Setterberg, Jr. | 277/125 |
| 4,319,393 | A | | 3/1982 | Pogonowski | 29/434 |
| 4,324,407 | A | | 4/1982 | Upham et al. | 277/27 |
| 4,429,620 | A | | 2/1984 | Burkhardt et al. | 91/395 |
| 4,531,581 | A | | 7/1985 | Pringle et al. | 166/120 |
| 4,588,030 | A | | 5/1986 | Blizzard | 166/120 |
| 4,697,640 | A | | 10/1987 | Szarka | 166/120 |
| 4,848,469 | A | | 7/1989 | Baugh et al. | 166/382 |
| 5,052,483 | A | | 10/1991 | Hudson | 166/55 |
| 5,222,555 | A | | 6/1993 | Bridges | 166/208 |
| 5,271,472 | A | | 12/1993 | Leturno | 175/107 |
| 5,409,059 | A | | 4/1995 | McHardy | 166/208 |
| 5,435,400 | A | | 7/1995 | Smith | 175/61 |
| 5,472,057 | A | | 12/1995 | Winfree | 175/57 |
| 5,542,454 | A | * | 8/1996 | Carlson et al. | 138/110 |
| 5,560,426 | A | | 10/1996 | Trahan et al. | 166/120 |
| 5,620,052 | A | | 4/1997 | Turner | 166/348 |
| 5,667,252 | A | | 9/1997 | Schafer et al. | 285/15 |
| 5,685,369 | A | | 11/1997 | Ellis et al. | 166/195 |
| 5,901,787 | A | | 5/1999 | Boyle | 166/135 |
| 6,021,850 | A | | 2/2000 | Wood et al. | 166/380 |
| 6,029,748 | A | | 2/2000 | Forsyth et al. | 166/380 |
| 6,098,717 | A | | 8/2000 | Bailey et al. | 166/382 |
| 6,189,616 | B1 | | 2/2001 | Gano et al. | 166/298 |
| 6,325,148 | B1 | | 12/2001 | Trahan et al. | 166/297 |
| 6,425,444 | B1 | | 7/2002 | Metcalfe et al. | 166/387 |
| 6,431,282 | B1 | | 8/2002 | Bosma et al. | 166/288 |
| 6,457,532 | B1 | | 10/2002 | Simpson | 166/380 |
| 6,488,095 | B2 | | 12/2002 | Buytaert | 166/382 |
| 2001/0040054 | A1 | | 11/2001 | Haugen et al. | 175/61 |
| 2001/0045284 | A1 | | 11/2001 | Simpson et al. | 166/313 |
| 2002/0145281 | A1 | | 10/2002 | Metcalfe et al. | 285/206 |

OTHER PUBLICATIONS

U.S. patent application Ser. No. 09/946,196, Lauritzen et al., filed Sep. 5, 2001.

U.S. patent application Ser. No. 09/938,176, Coon, filed Aug. 23, 2001.

U.S. patent application Ser. No. 09/938,168, Coon, filed Aug. 23, 2001.

U.S. patent application Ser. No. 09/904,735, Badrak et al., filed Jul. 13, 2001.

PCT International Search Report, International Application No. PCT/GB02/03936, Dated Oct. 24, 2002.

U.S. patent application Ser. No. 09/470,176, Metcalfe et al., filed Dec. 22, 1999.

U.S. patent application Ser. No. 09/470,154, Metcalfe et al., filed Dec. 22, 1999.

U.S. patent application Ser. No. 09/469,690, Abercrombie, filed Dec. 22, 1999.

U.S. patent application Ser. No. 09/469,643, Metcalfe et al., filed Dec. 22, 1999.

U.S. patent application Ser. No. 09/469,526, Metcalfe et al., filed Dec. 22, 1999.

U.S. patent application Ser. No. 09/469,681, Metcalfe et al., filed Dec. 22, 1999.

U.S. patent application Ser. No. 09/462,654, Metcalfe, filed Dec. 19, 2000.

* cited by examiner

EXPANDABLE HANGER AND PACKER

CROSS-REFERENCE TO RELATED APPLICATION

This application is a continuation-in-part of co-pending U.S. patent application Ser. No. 09/949,986 filed Sep. 10, 2001 and incorporated by reference herein in its entirety.

BACKGROUND OF THE INVENTION

1. Field of the Invention

The present invention relates to wellbore completion. More particularly, the invention relates to an apparatus and method for creating an attachment and a seal between two tubulars in a wellbore.

2. Description of the Related Art

In the drilling of oil and gas wells, a wellbore is formed using a drill bit that is urged downwardly at a lower end of a drill string. After drilling a predetermined depth, the drill string and bit are removed, and the wellbore is lined with a string of steel pipe called casing. The casing provides support to the wellbore and facilitates the isolation of certain areas of the wellbore adjacent hydrocarbon bearing formations. The casing typically extends down the wellbore from the surface of the well to a designated depth. An annular area is thus defined between the outside of the casing and the earth formation. This annular area is filled with cement to permanently set the casing in the wellbore and to facilitate the isolation of production zones and fluids at different depths within the wellbore.

It is common to employ more than one string of casing in a wellbore. In this respect, a first string of casing is set in the wellbore when the well is drilled to a first designated depth. The well is then drilled to a second designated depth, and a second string of casing, or liner, is run into the well to a depth whereby the upper portion of the second liner is overlapping the lower portion of the first string of casing. The second liner string is then fixed or hung in the wellbore, usually by some mechanical slip mechanism well-known in the art, and cemented. This process is typically repeated with additional casing strings until the well has been drilled to total depth.

After the initial string of casing is set, the wellbore is drilled to a new depth. An additional string of casing, or liner, is then run into the well to a depth whereby the upper portion of the liner, is overlapping the lower portion of the surface casing. The liner string is then fixed or hung in the wellbore, usually by some mechanical slip mechanism well known in the art, commonly referred to as a hanger.

Downhole tools with sealing elements are placed within the wellbore to isolate areas of the wellbore fluid or to manage production fluid flow from the well. These tools, such as plugs or packers, for example, are usually constructed of cast iron, aluminum or other alloyed metals and include slip and sealing means. The slip means fixes the tool in the wellbore and typically includes slip members and cores to wedgingly attach the tool to the casing well. In addition to slip means, conventional packers include a synthetic sealing element located between upper and lower metallic retaining rings.

The sealing element is set when the rings move towards each other and compress the element there between, causing it to expand outwards into an annular area to be sealed and against an adjacent tubular or wellbore. Packers are typically used to seal an annular area formed between two coaxially disposed tubulars within a wellbore. For example, packers may seal an annulus formed between production tubing disposed within wellbore casing. Alternatively, packers may seal an annulus between the outside of the tubular and an unlined borehole. Routine uses of packers include the protection of casing from pressure, both well and stimulation pressures, as well as the protection of the wellbore casing from corrosive fluids. Other common uses include the isolation of formations or leaks within a wellbore casing or multiple production zones, thereby preventing the migration of fluid between zones. Packers may also be used to hold fluids or treating fluids within the casing annulus in the case of formation treatment, for example.

One problem associated with conventional sealing and slip systems of conventional downhole tools relates to the relative movement of the parts necessary in order to set the tools in a wellbore. Because the slip and sealing means require parts of the tool to be moved in opposing directions, a run-in tool or other mechanical device must necessarily run into the wellbore with the tool to create the movement. Additionally, the slip means takes up valuable annular space in the wellbore. Also, the body of a packer necessarily requires wellbore space and reduces the bore diameter available for production tubing, etc.

A recent trend in well completion has been the advent of expandable tubular technology. It has been discovered that both slotted and solid tubulars can be expanded in situ so as to enlarge the inner diameter. This, in turn, enlarges the path through which both fluid and downhole tools may travel. Also, expansion technology enables a smaller tubular to be run into a larger tubular, and then expanded so that a portion of the smaller tubular is in contact with the larger tubular therearound. Tubulars are expanded by the use of a cone-shaped mandrel or by an expander tool with expandable, fluid actuated members disposed on a body and run into the wellbore on a tubular string. During expansion of a tubular, the tubular walls are expanded past their elastic limit. Examples of expandable tubulars include slotted screen, joints, packers, and liners. The use of expandable tubulars as hangers and packers allows for the use of larger diameter production tubing, because the conventional slip mechanism and sealing mechanism are eliminated.

While expanding tubulars in a wellbore offers obvious advantages, there are problems associated with using the technology to create a hanger or packer through the expansion of one tubular into another. By plastically deforming the tubular, the cross-sectional thickness of the tubular is necessarily reduced. Simply increasing the initial cross-sectional thickness of the tubular to compensate for the reduced tensile strength after expansion results in an increase in the amount of force needed to expand the tubular.

More importantly, when compared to a conventional hanger, an expanded tubular with no gripping structure on the outer surface has a reduced capacity to support the weight of a liner. This is due to a reduced coefficient of friction of the outer surface of an expandable tubular in comparison to the slip mechanism having teeth or other gripping surfaces formed thereon. In another problem, the expansion of the tubular in the wellbore results in an ineffective seal between the expanded tubular and the surrounding wellbore.

A need therefore exists for an expandable tubular connection with increased strength. There is a further need for an expandable tubular connection providing an improved gripping surface between an expanded tubular and an inner wall of a surrounding tubular. Yet a further need exists for an expandable tubular configured to allow metal flow upon expansion to insure contact and sealing capabilities between an expanded tubular and an inner wall of a surrounding tubular. There is yet a further need for an expandable tubular with an increased capacity to support the weight of a liner.

SUMMARY OF THE INVENTION

The present invention generally relates to an apparatus and method for engaging a first tubular and a second tubular in a wellbore. The present invention provides a tubular body formed on a portion of a first tubular. The tubular body is expanded so that the outer surface of the tubular body is in frictional contact with the inner surface of a surrounding second tubular. In one embodiment, the tubular body is modified by machining grooves and profile cuts into the surface, thereby reducing the amount of radial force required to expand the tubular body on the first tubular into the surrounding tubular.

The tubular body optionally includes hardened inserts, such as carbide buttons, for gripping the surrounding tubular upon contact. The gripping mechanism increases the capacity of the expanded tubular to support its weight and to serve as a hanger. In another aspect, the outer surface of the expandable tubular body optionally includes a pliable material such as an elastomer within grooves and profile cuts formed on the outer surface of the tubular for increasing the sealing capability of the expandable tubular. As the tubular is expanded, metal flow causes the profile cuts to close up, thereby causing the pliable material to extrude outward. This extrusion of the pliable material insures contact with the casing and improves the sealing characteristics of the interface between the expanded tubular and the casing.

BRIEF DESCRIPTION OF THE DRAWINGS

So that the manner in which the above recited features and advantages of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
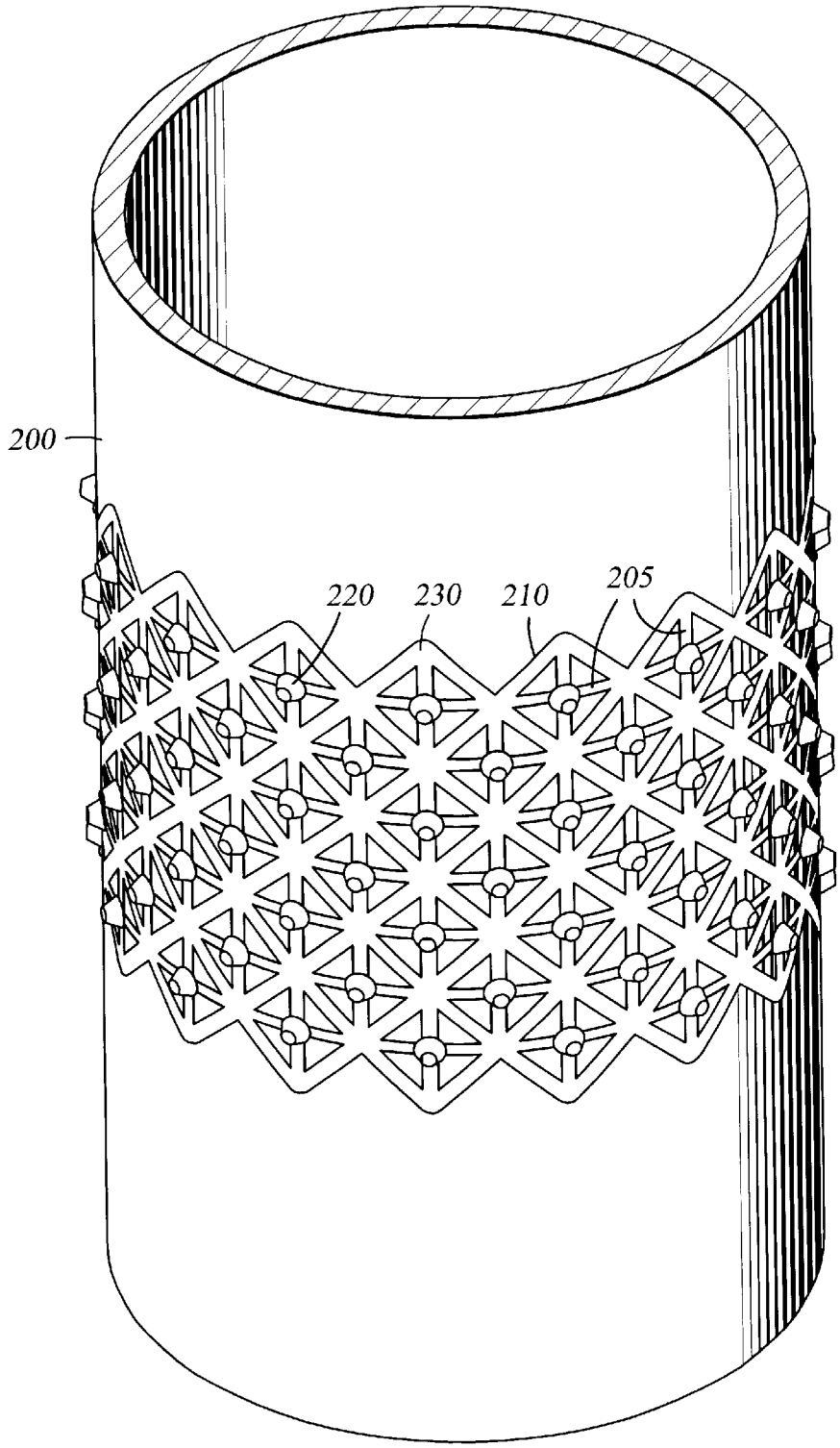
FIG. 1 is a perspective view of a tubular having profile cuts that intersect corners of the grooves formed in the outer surface, and having inserts of a hardened material also disposed around the outer surface.

FIG. 1 is a perspective view of the apparatus of the present invention. The apparatus 200 defines a tubular body formed on a portion of a larger tubular. The tubular body 200 shown in FIG. 1 includes a series of relief grooves 210 and profile cuts 205 machined into the outer surface. However, it is within the scope of the present invention to machine some or all of the grooves 210 into the inner surface of the expandable tubular 200. The relief grooves 210 and profile cuts 205 serve to reduce the thickness of the tubular 200, thereby reducing the amount of material that must be plastically deformed in order to expand the tubular 200. This reduction in material also results in a reduction in the amount of force needed to expand the tubular 200.

As shown in FIG. 1, the grooves 210 are machined in a defined pattern. Employment of a pattern of grooves 210 serves to increase the tensile properties of the tubular 200 beyond those of a tubular with straight grooves simply cut around the circumference of the tubular. This improvement in tensile properties is due to the fact that the variation in cross-sectional thickness will help to prevent the propagation of any cracks formed in the tubular. The pattern of grooves depicted in FIG. 1 is a continuous pattern of grooves 210 about the circumference of the body 200, with the grooves 210 intersecting to form a plurality of substantially identical shapes. In the preferred embodiment, the shapes are diamonds. However, the scope of this invention is amenable to other shapes, including but not limited to polygonal shapes, and interlocking circles, loops or ovals (not shown).

In one embodiment, the profile cuts 205 are formed on the surface of the shapes created by the grooves 210. The profile cuts 205 are formed at a predetermined depth less than the grooves 210 so that the profile cuts 205 will not substantially affect the compressive or tension capabilities of the tubular 200 upon expansion. The profile cuts 205 may be horizontal cuts, vertical cuts or combinations thereof to divide each shape into two or more portions. Preferably, the profile cuts 205 intersect the corners of the grooves 210 as depicted on FIG. 1.

FIG. 1 also depicts inserts 220 interdisposed within the pattern of grooves 210 and profile cuts 205. The inserts 220 provide a gripping means between the outer surface of the tubular 200 and the inner surface of a larger diameter tubular (not shown) within which the tubular 200 is coaxially disposed. The inserts 220 are made of a suitably hardened material, and are attached to the outer surface of the tubular 200 through a suitable means such as soldering, epoxying or other adhesive method, or via threaded connection. In the preferred embodiment, carbide inserts 220 are press-fitted into preformed apertures in the outer surface of tubular body 200. After expansion, the inserts 220 are engaged with the inner surface of a larger diameter tubular (not shown), thereby increasing the ability of the expanded tubular 200 to support the weight of the tubular below the expanded portion.

In the embodiment shown in FIG. 1, carbide inserts 220 are utilized as the gripping means. However, other materials may be used for fabrication of the inserts 220 so long as the inserts 220 are sufficiently hard to be able to grip the inner surface of an outer tubular during expansion of the tubular body 200. Examples of fabrication materials for the inserts 220 include ceramic materials (such as carbide) and hardened metal alloy materials. The carbide inserts 220 define raised members fabricated into the tubular body 200. However, other embodiments of gripping means may alternatively be employed. Such means include but are not limited to buttons having teeth (not shown), or other raised or serrated members on the outer surface of the expandable tubular 200. Alternatively, the gripping means may define a plurality of hardened tooth patterns added to the outer surface of the tubular body 200 between the grooves 210 themselves.

The embodiment of FIG. 1 also depicts a pliable material 230 disposed within the grooves 210 and profile cuts 205. The pliable material 230 increases the ability of the tubular 200 to seal against an inner surface of a larger diameter tubular upon expansion. In the preferred embodiment, the pliable member 230 is fabricated from an elastomeric material. However, other materials are suitable which enhance the fluid seal sought to be obtained between the expanded portion of tubular 200 and an outer tubular, such as surface casing (not shown). The pliable material 230 is disposed within the grooves 210 and profile cuts 205 by a thermal process, or some other well known means. A thin layer of the pliable material 230 may also encapsulate the inserts 220 and facilitate the attachment of the inserts 220 to the tubular 200.

Figure 2:
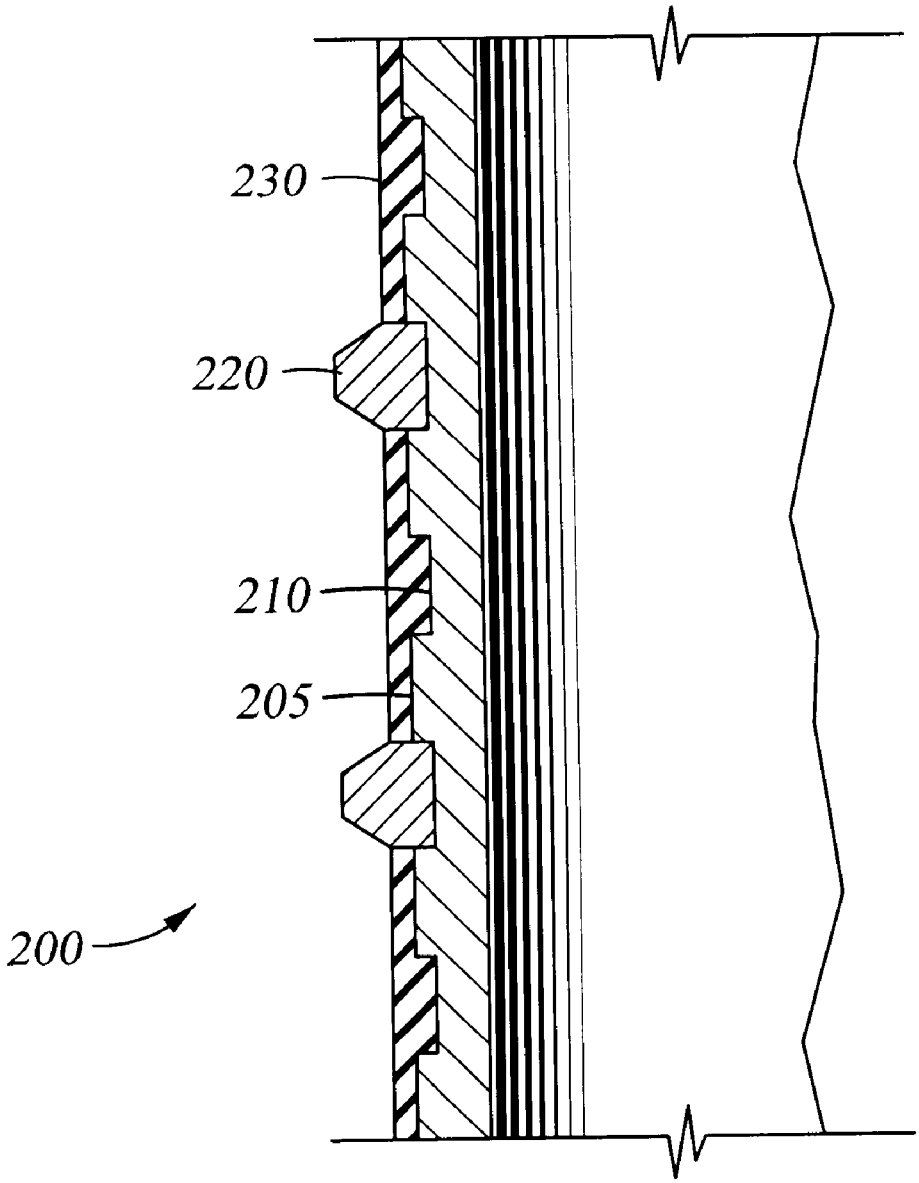
FIG. 2 is a section view of the tubular of FIG. 1.

FIG. 2 is a section view of a portion of the tubular 200 of FIG. 1. In this view, the inserts 220 are shown attached to the tubular 200 in the areas between the grooves 210 and at an intersection of the profile cuts 205. In this respect, the inserts 220 are interdispersed within the pattern of grooves 210 and profile cuts 205. FIG. 2 also clearly shows the reduction in cross-sectional thickness of the tubular 200 created by the grooves 210 and profile cuts 205 before expansion. FIG. 2 further shows the profile cuts 205 formed at a depth less than the grooves 210.

Figure 4:
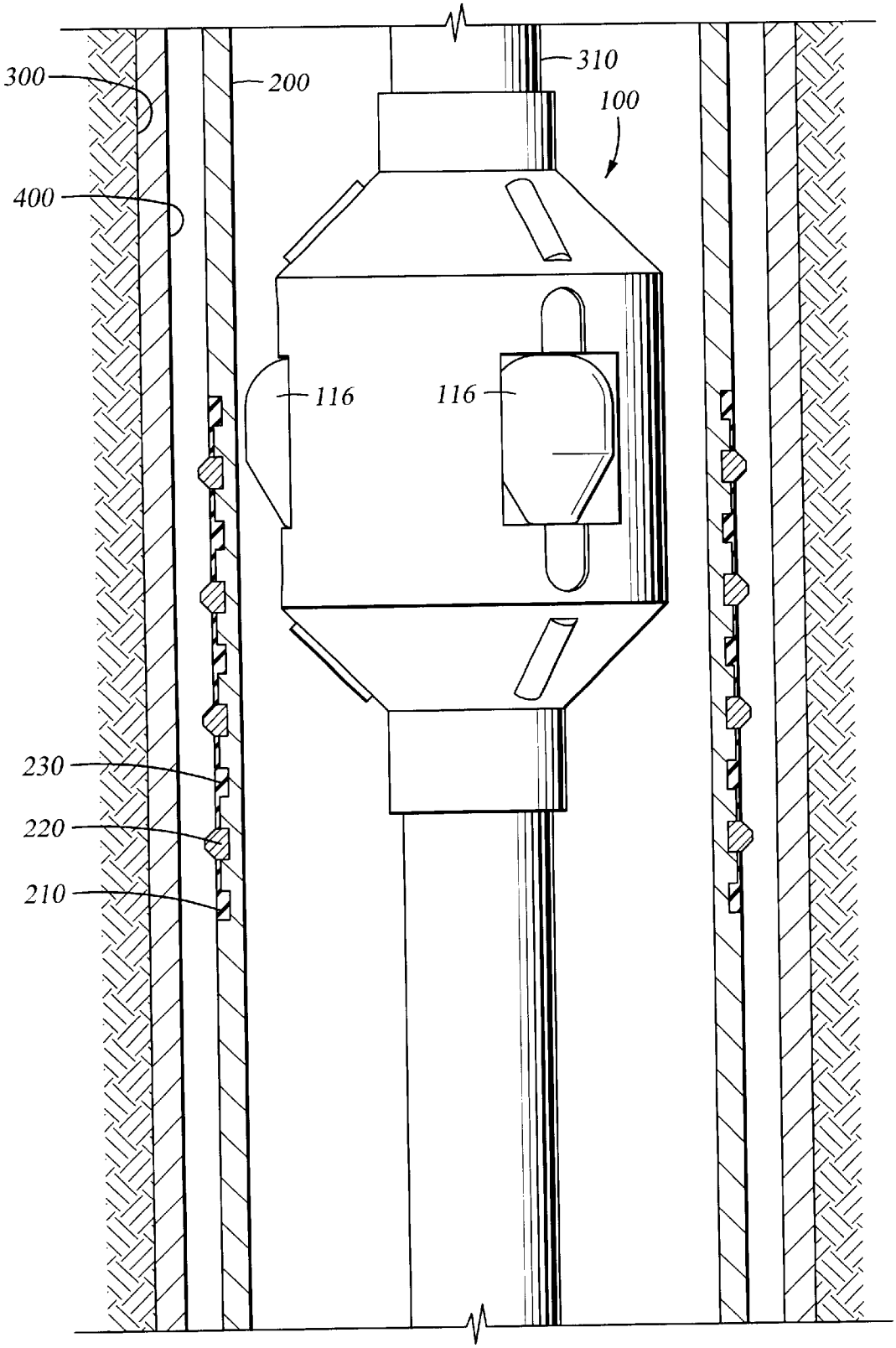
FIG. 4 is a partial section view of a tubular of the present invention within a wellbore, and showing an expander tool attached to a working string also disposed within the tubular.

The inserts 220 in FIG. 2 have a somewhat conical shape projecting from the outer surface of the tubular 200 to assist in engagement of the inserts 200 into an outer tubular (shown in FIG. 4). For clarity, the inserts are exaggerated in the distance they extend from the surface of the tubular. In one embodiment, the inserts extend only about 0.03 inches outward prior to expansion. In another embodiment, the raised members 220 are initially recessed, either partially or completely, with respect to the tubular 200, and then extend at least partially outward into contact with the casing after expansion. Such an embodiment is feasible for the reason that the wall thickness of the tubular 200 becomes thinned during the expansion process, thereby exposing an otherwise recessed raised member.

Figure 3:
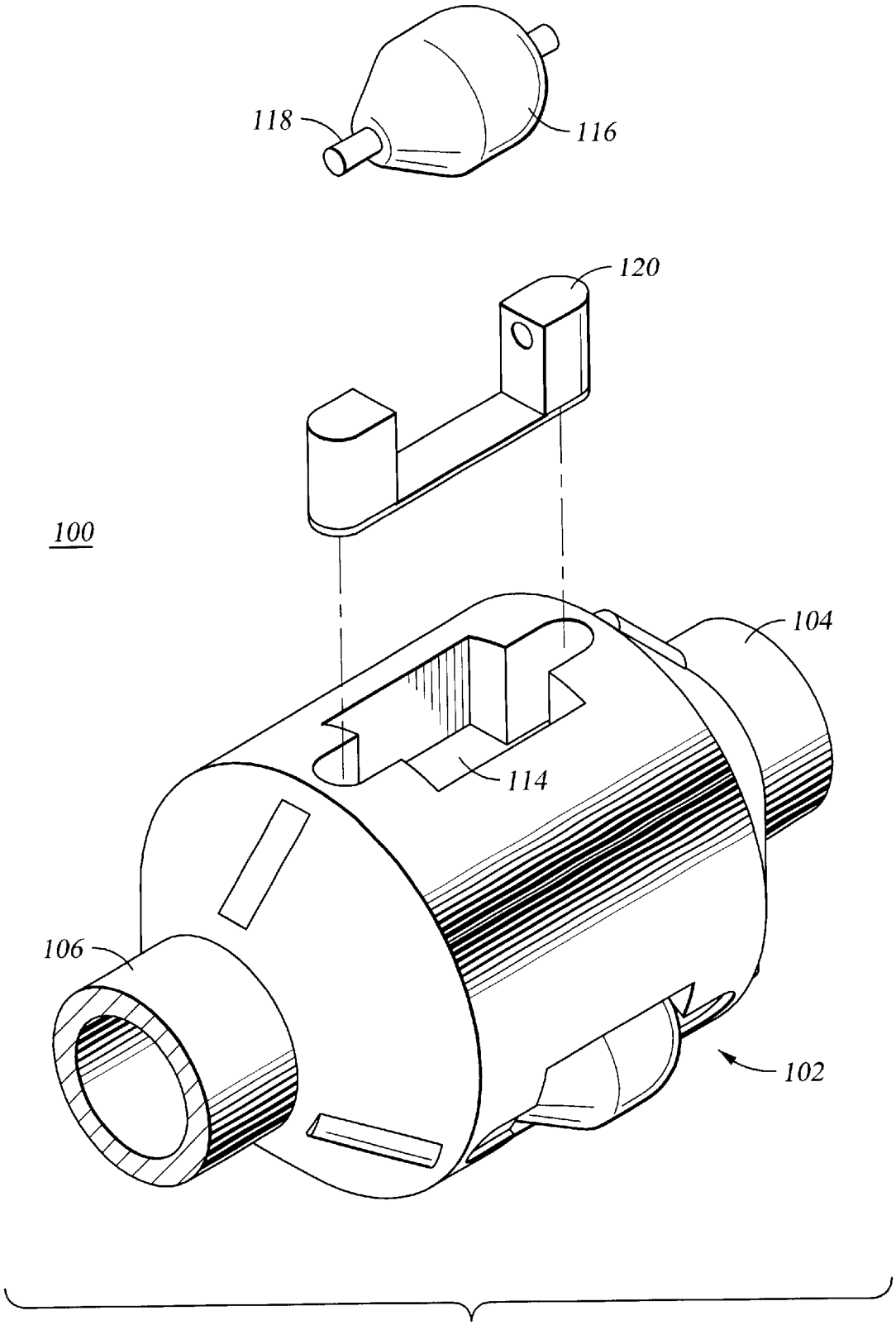
FIG. 3 is an exploded view of an exemplary expander tool.

The tubular body 200 of the present invention is expanded by an expander tool 100 acting outwardly against the inside surface of the tubular 200. FIG. 3 is an exploded view of an exemplary expander tool 100 for expanding the tubular 200. The expander tool 100 has a body 102, which is hollow and generally tubular with connectors 104 and 106 for connection to other components (not shown) of a downhole assembly. The connectors 104 and 106 are of a reduced diameter compared to the outside diameter of the longitudinally central body part of the tool 100. The central body part 102 of the expander tool 100 shown in FIG. 3 has three recesses 114, each holding a respective roller 116. Each of the recesses 114 has parallel sides and extends radially from a radially perforated tubular core (not shown) of the tool 100. Each of the mutually identical rollers 116 is somewhat cylindrical and barreled. Each of the rollers 116 is mounted by means of an axle 118 at each end of the respective roller 116 and the axles are mounted in slidable pistons 120. The rollers 116 are arranged for rotation about a respective rotational axis that is parallel to the longitudinal axis of the tool 100 and radially offset therefrom at 120-degree mutual circumferential separations around the central body 102. The axles 118 are formed as integral end members of the rollers 116, with the pistons 120 being radially slidable, one piston 120 being slidably sealed within each radially extended recess 114. The inner end of each piston 120 is exposed to the pressure of fluid within the hollow core of the tool 100 by way of the radial perforations in the tubular core. In this manner, pressurized fluid provided from the surface of the well, via a working string 310, can actuate the pistons 120 and cause them to extend outward whereby the rollers 116 contact the inner wall of a tubular 200 to be expanded.

FIG. 4 is a partial section view of a tubular 200 of the present invention in a wellbore 300. The tubular 200 is disposed coaxially within the casing 400. An expander tool 100 attached to a working string 310 is visible within the tubular 200. Preferably, the tubular 200 is run into the wellbore 300 with the expander tool 100 disposed therein. The working string 310 extends below the expander tool 100 to facilitate cementing of the tubular 200 in the wellbore 300 prior to expansion of the tubular 200 into the casing 400. A remote connection (not shown) between the working, or run-in, string 310 and the tubular 200 temporarily connects the tubular 200 to the run-in string 310 and supports the weight of the tubular 200. In one embodiment of the present invention, the temporary connection is a collett (not shown), and the tubular 200 is a string of casing.

FIG. 4 depicts the expander tool 100 with the rollers 116 retracted, so that the expander tool 100 may be easily moved within the tubular 200 and placed in the desired location for expansion of the tubular 200. Hydraulic fluid (not shown) is pumped from the surface to the expander tool 100 through the working string 310. When the expander tool 100 has been located at the desired depth, hydraulic pressure is used to actuate the pistons (not shown) and to extend the rollers 116 so that they may contact the inner surface of the tubular 200, thereby expanding the tubular 200.

FIG. 4 also shows the carbide inserts 220 attached to the outer surface of the tubular 200. Because the tubular 200 has not yet been expanded, the carbide inserts 220 are not in contact with the casing 400 so as to form a grip between the tubular 200 and casing 400. FIG. 4 also shows the pliable material 230 disposed within the grooves 210 and the profile cuts 205.

Figure 5:
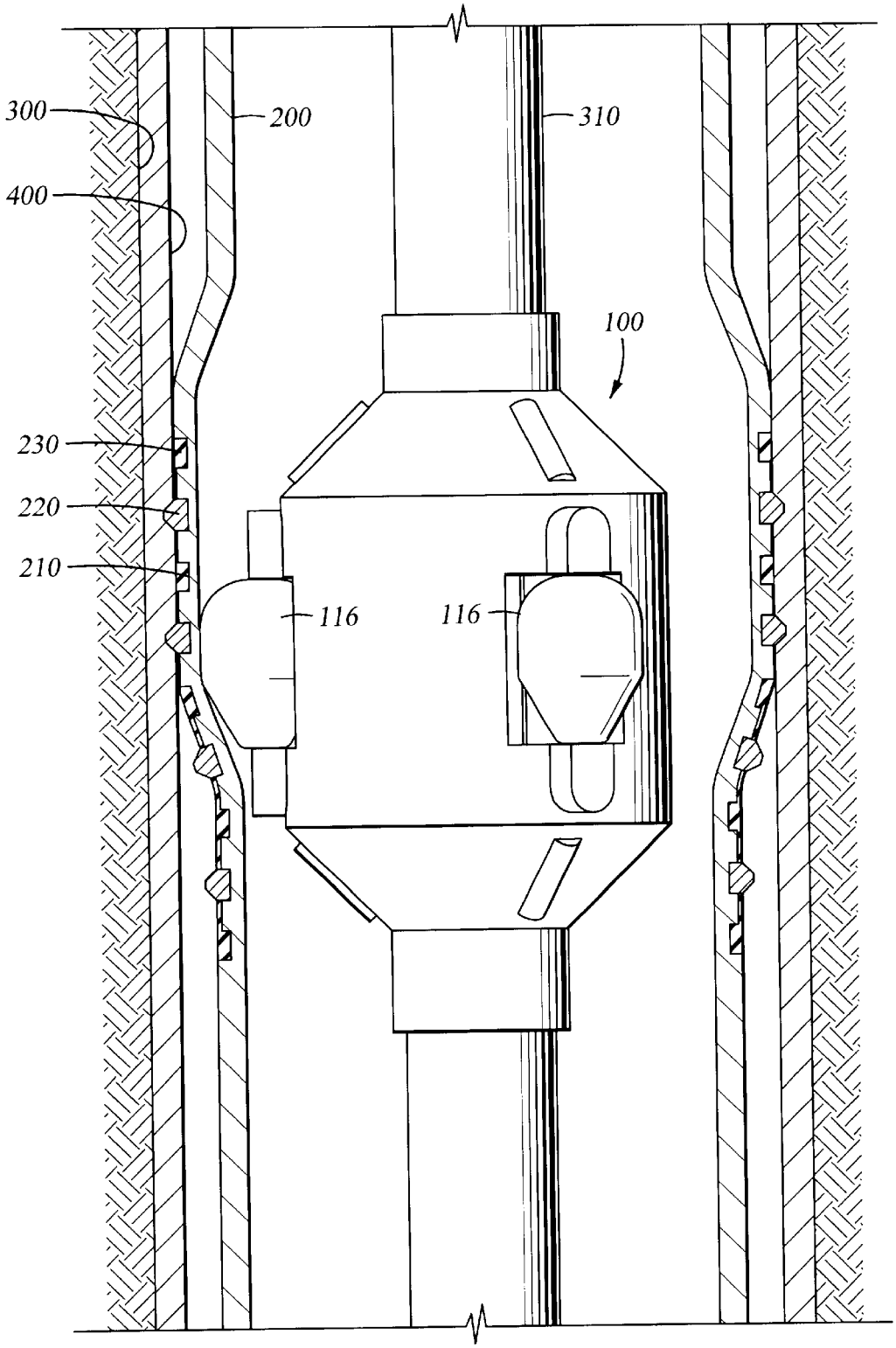
FIG. 5 is a partial section view of the tubular of FIG. 4 partially expanded by the expander tool.

FIG. 5 is a partial section view of the tubular 200 partially expanded by the expander tool 100. At a predetermined pressure, the pistons (not shown) in the expander tool 100 are actuated and the rollers 116 are extended until they contact the inside surface of the tubular 200. The rollers 116 of the expander tool 100 are further extended until the rollers 116 plastically deform the tubular 200 into a state of permanent expansion. The working string 310 and the expander tool 100 are rotated during the expansion process, and the tubular 200 is expanded until the tubular's outer surface contacts the inner surface of the casing 400. As the tubular 200 contacts the casing 400, the inserts 220 begin to engage the inner surface of the casing 400.

The grooves 210 are also expanded during this expansion process, thereby causing some of the metal around the grooves 210 to flow away from the grooves 210. The metal flow is redistributed in the shallower profile cuts 205, thereby closing the profile cuts 205. As the profile cuts 205 close, the pliable material 230 in the profile cuts 205 extrudes outward into contact with the casing 400. Further, the pliable material 230 in the grooves 210 fills a space remaining between the grooves 210 and the casing 400. After the pliable material 230 contacts the casing 400, the interface between the expanded tubular 200 and the casing 400 is sealed. The working string 310 and expander tool 100 are then translated within the tubular 200 until the desired length of the tubular 200 has been expanded.

Figure 6:
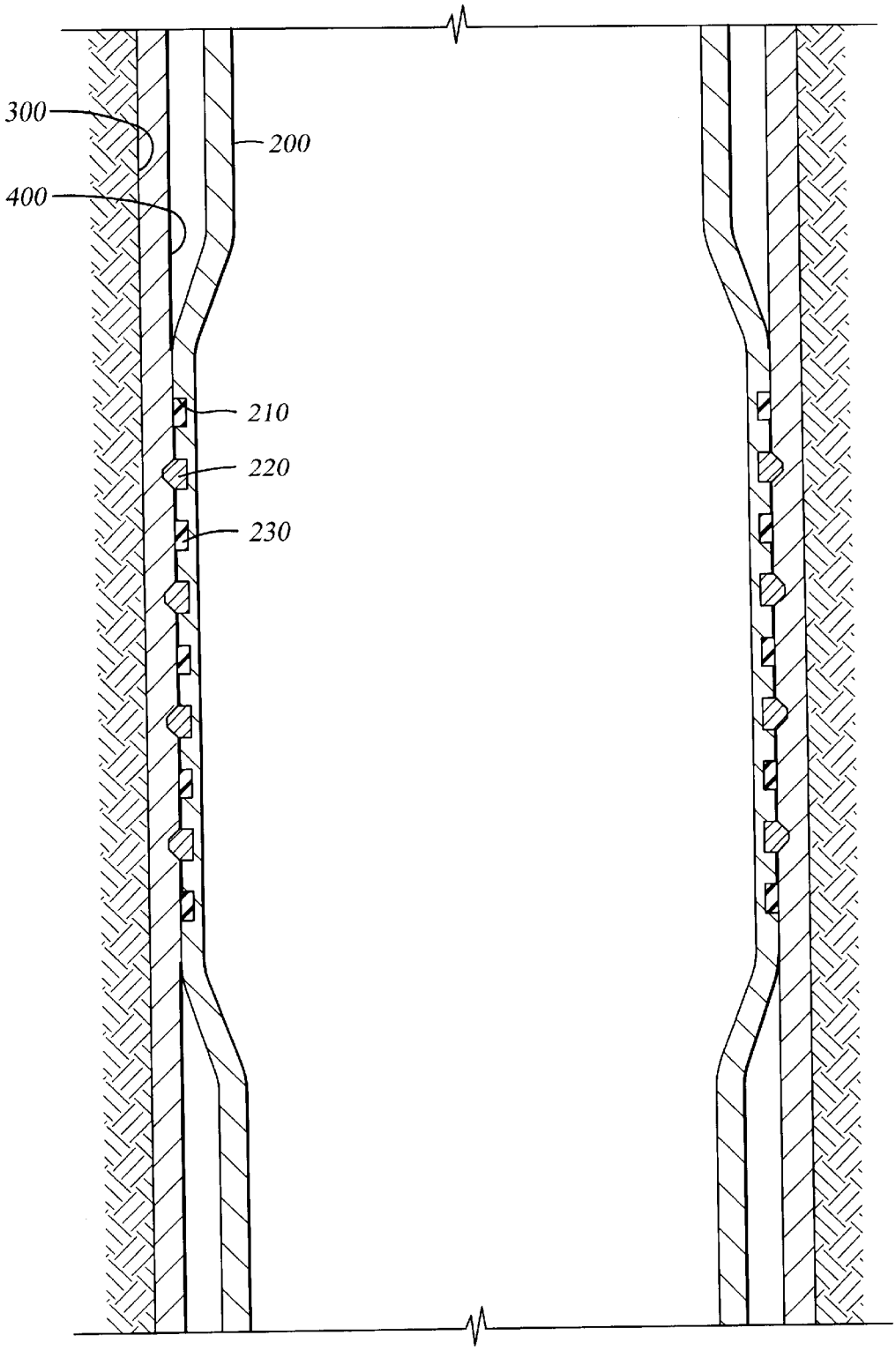
FIG. 6 is a partial section view of an expanded tubular in the wellbore with the expander tool and working string removed.

FIG. 6 is a partial section view of an expanded tubular 200 in a wellbore 300, with the expander tool 100 and working string 310 removed. FIG. 6 depicts the completed expansion process, after which the expanded portion of the tubular 200 defines both a packer and a hanger. As a packer, the expanded portion of the tubular 200 seals the annular area between the casing 400 and the tubular 200. As a hanger, the expanded portion of the tubular 200 supports the weight of the tubular 200.

FIG. 6 shows the engagement between the inserts 220 and the inner surface of the casing 400. The engagement enables the expanded portion of the tubular 200 to support an increased weight in comparison to an expanded tubular without inserts. The inserts 220 axially and rotationally fix the outer surface of the expanded tubular 200 to the inner surface of the casing 400. Further, the profile cuts 205 are closed and the pliable material 230 that was in the profile cuts 205 and the grooves 210 is disposed in the interface between the expanded tubular 200 and the casing 400.

While the foregoing is directed to embodiments of the present invention, other and further embodiments of the invention may be directed without departing from the basic scope thereof, and the scope thereof is determined by the claims that follow.

What is claimed is:

1. An apparatus for engaging a first tubular and a second tubular in a wellbore, the apparatus comprising:

a tubular body formed on the first tubular, having an inner surface and an outer surface, the tubular body being expandable radially outward into contact with an inner wall of the second tubular by the application of an outwardly directed force supplied to the inner surface of the tubular body;

grooves formed on the tubular body; and at least one profile cut formed in the outer surface of the tubular body.

2. The apparatus of claim 1, whereby the at least one profile cut is constructed and arranged to close upon expansion of the tubular body.

3. The apparatus of claim 1, wherein the at least one profile cut is formed at a depth less than a depth of the grooves.

4. The apparatus of claim 3, wherein the grooves formed are substantially filled with a pliable material.

5. The apparatus of claim 1, wherein the at least one profile cut is substantially filled with a pliable material.

6. The apparatus of claim 1, wherein the grooves are formed in a pattern and the pattern of the grooves is a continuous pattern about the circumference of the body, the grooves intersecting to form a plurality of substantially identical shapes.

7. The apparatus of claim 6, wherein the substantially identical shapes comprise diamonds.

8. The apparatus of claim 6, wherein the at least one profile cut are formed on the surface of the plurality of substantially identical shapes, whereby the at least one profile cut intersects the grooves.

9. The apparatus of claim 1, further comprising gripping means formed on the outer surface of the tubular body for further increasing friction between the first and second tubulars upon expansion of the tubular body.

10. The apparatus of claim 9, wherein the gripping means define raised members extending outward from the outer surface of the body.

11. The apparatus of claim 10, wherein the raised members define inserts interdisposed in the pattern of the grooves.

12. The apparatus of claim 11, wherein the inserts are press-fitted into preformed apertures in the outer surface of the tubular body.

13. The apparatus of claim 12, wherein the inserts are fabricated from a hardened metal alloy.

14. The apparatus of claim 12, wherein the inserts are fabricated from a ceramic material.

15. The apparatus of claim 12, wherein the raised members defines a plurality of buttons having teeth.

16. An apparatus for engaging a first tubular and a second tubular in a wellbore, the apparatus comprising:

a tubular body formed on the first tubular, having an inner surface and an outer surface, the tubular body being expandable radially outward into contact with an inner wall of the second tubular by the application of an outwardly directed force supplied to the inner surface of the tubular body;

a gripping means formed on the outer surface of the tubular body for further increasing friction between the first and second tubulars upon expansion of the tubular body;

a plurality of grooves formed on the tubular body; and a plurality of profile cuts formed in the outer surface of the tubular body, wherein the plurality of profile cuts intersect the grooves.

17. The apparatus of claim 16, wherein grooves are formed on the outer surface or inner surface of the tubular body or combinations thereof.

18. The apparatus of claim 16, wherein the plurality of profile cuts are formed at a depth less than the plurality of grooves.

19. The apparatus of claim 16, wherein the plurality of grooves and the plurality of profile cuts are formed in a pattern.

20. The apparatus of claim 19, wherein the pattern of the plurality of grooves is a continuous pattern about the circumference of the body, the plurality of grooves intersecting to form a plurality of substantially identical shapes.

21. The apparatus of claim 16, wherein the plurality of grooves and the plurality of profile cuts are substantially filled with a pliable material.

22. The apparatus of claim 16, wherein the gripping means define inserts interdisposed in the pattern of the plurality of grooves.

23. A method of completing a wellbore comprising the steps of:

providing a first tubular, the first tubular having a plurality of relief grooves and profile cuts disposed in a continuous pattern about the circumference of the first tubular body, the grooves intersecting to form a plurality of substantially identical shapes and the profile cuts are formed at a depth less than the grooves;

positioning a second tubular within a wellbore;

positioning the first tubular coaxially within a portion of the second tubular, the second tubular having an inner diameter which is larger than the outer diameter of the first tubular;

positioning an expander tool within the first tubular at a depth proximate the pattern of the grooves and profile cuts;

activating the expander tool so as to apply a force to the inner surface of the first tubular, thereby expanding the first tubular such that the outer surface of the first tubular is in frictional contact with the inner surface of the second tubular.

24. The method of claim 23, wherein the grooves and the profile cuts are substantially filled with a pliable material.

25. The method of claim 24 further comprising the step of positioning gripping means on the outer surface of the tubular body interdispersed between the grooves for further increasing friction between the first and second tubulars upon expansion of the first tubular.

26. The method of claim 25, wherein the gripping means defines a plurality of raised members extending outward from the outer surface of the first tubular.

27. The method of claim 26, wherein the plurality of raised members define inserts press-fitted into preformed apertures in the outer surface of the first tubular.

28. The method of claim 27, wherein the plurality of raised members are initially recessed at least partially within the wall of the tubular body, but then protrude from the outer surface of the tubular body upon expansion of the tubular body.

29. The method of claim 25, wherein the gripping means defines a plurality of hardened tooth patterns added to the outer surface of the tubular body between the grooves.

30. The method of claim 23, wherein the first and the second tubular are each a string of casing.

31. The method of claim 23, whereby, as the first tubular is expanded, the profile cuts close.

* * * * *